US007594736B1

(12) United States Patent
Kassay et al.

(10) Patent No.: US 7,594,736 B1
(45) **Date of Patent: *Sep. 29, 2009**

(54) FLUORESCENT LIGHTING FIXTURES WITH LIGHT TRANSMISSIVE WINDOWS AIMED TO PROVIDE CONTROLLED ILLUMINATION ABOVE THE MOUNTED LIGHTING FIXTURE

(76) Inventors: Charles E. Kassay, 5 North Ave., Smithtown, NY (US) 11787; Suzanne M. Kassay, 5 North Ave., Smithtown, NY (US) 11787; Marc A. Kassay, 5 North Ave., Smithtown, NY (US) 11787; John P. Kassay, 5 North Ave., Smithtown, NY (US) 11787

( * ) Notice: Subject to any disclaimer, the term of this patent is extended or adjusted under 35 U.S.C. 154(b) by 0 days.

This patent is subject to a terminal disclaimer.

(21) Appl. No.: 11/976,194

(22) Filed: Oct. 22, 2007

(51) Int. Cl.
*F21S 4/00* (2006.01)

(52) U.S. Cl. ..... 362/225; 362/241; 362/247; 362/297; 362/223

(58) Field of Classification Search ..... 362/225, 362/147, 297, 346, 404, 240, 247, 307, 237, 362/241
See application file for complete search history.

(56) References Cited

U.S. PATENT DOCUMENTS

| | | | | |
|---|---|---|---|---|
| 2,433,819 | A * | 12/1947 | Scribner | 248/343 |
| 2,936,991 | A * | 5/1960 | Picha et al. | 248/343 |
| 5,192,128 | A * | 3/1993 | Ngai | 362/297 |
| 6,505,953 | B1 * | 1/2003 | Dahlen | 362/217 |

* cited by examiner

*Primary Examiner*—Thomas M Sember

(57) ABSTRACT

A fluorescent light fixture with light transmissive windows aimed to provide controlled illumination above the mounted lighting fixture includes a housing having an elongated horizontal top surface with side edges and edges at opposite ends of the top surface. Oblique walls extend from the side edges of the top surface, and flare downwardly and outwardly from the side edges. First and second end walls extend downwardly from opposite ends of the top surface, the oblique walls and end walls joining to form a downwardly facing opening in the housing. Fluorescent light bulbs are mounted parallel to each other in the housing, so that light from selected light bulbs is reflected generally downwardly. The oblique walls include a plurality of spaced windows configured to direct a controlled portion of light from one or more light bulbs in a generally upward direction to provide indirect lighting.

8 Claims, 6 Drawing Sheets

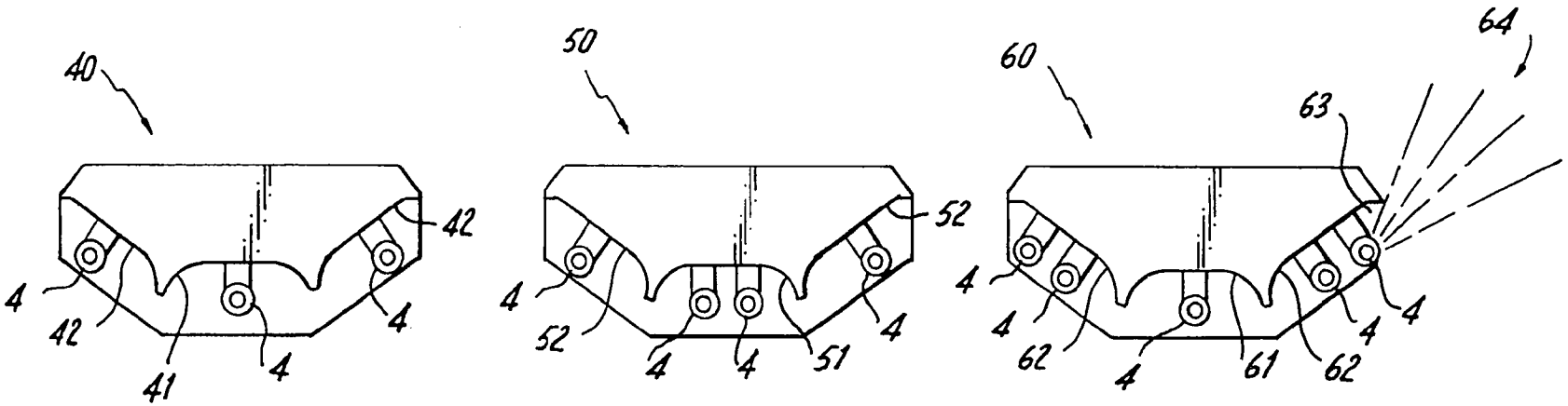
FIG. 6
FIG. 7
FIG. 8
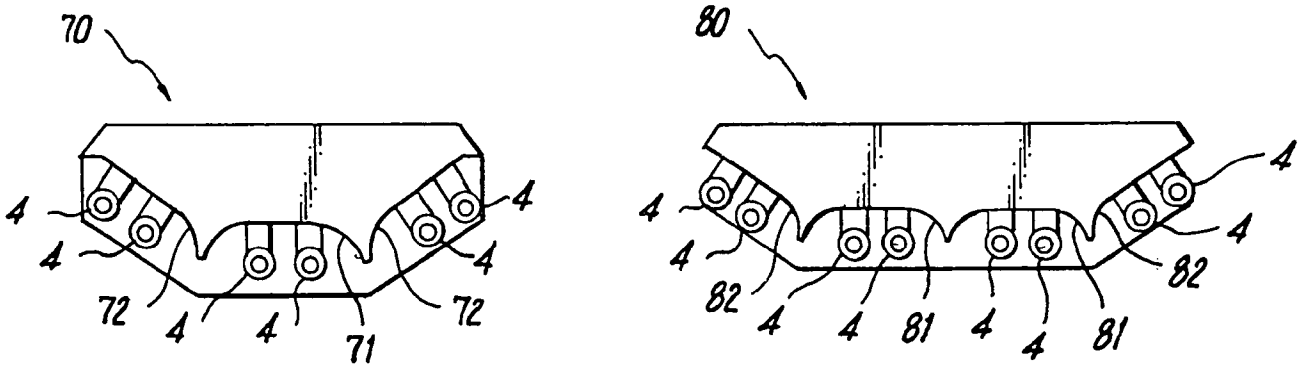
FIG. 9
FIG. 10

FLUORESCENT LIGHTING FIXTURES WITH LIGHT TRANSMISSIVE WINDOWS AIMED TO PROVIDE CONTROLLED ILLUMINATION ABOVE THE MOUNTED LIGHTING FIXTURE

BACKGROUND OF THE INVENTION

This application claims priority to co-pending patent application Ser. No. 11/430,347, filed May 9, 2006, the entire disclosure of which is incorporated herein by reference. This application is owned by the owner of application Ser. No. 10/750,391, filed Dec. 31, 2003, now issued as U.S. Pat. No. 7,070,303, the entireties of which are also incorporated herein by reference.

1. Field of the Invention

The present invention relates to electrically powered lighting fixtures including fluorescent lighting fixtures adapted for use indoors or beneath a ceiling.

2. Discussion of the Prior Art

In order to make a large area visually comfortable, downlight fixtures often include some uplight capabilities, to reduce the "cave" effect caused by ceiling fixtures being too intense for the viewer to see the ceiling beyond the fixtures. The cave effect causes a glare-filled, enclosed effect, which increases eyestrain.

However, too much uplighting is inefficient and wasteful, not reflecting a large portion of emitted light back to the space below the fixture.

To provide uplight, it is known to have an open top, which wastes light usage, as much of the light is not reflected back to the space below the fixture. In addition, in general, however, lamp fixtures with open tops have a susceptibility to dirt accumulation.

Among related patents include U.S. Pat. No. 2,281,377 of Ohm, which has a slanted transparent/translucent wall but no reflector, which does not control uplight to a preferable maximum of 5-19% (by bent and concave angles of the reflector). Ohm's wall 13 is convex, so most light is not controlled. If a fixture were made similar to that of Ohm '377, wherein it would be fabricated without the lens, the fluorescent lamps would extend beyond the plane of the side of the fixture, allowing for excessive dirt accumulation thereon. Furthermore, if one would make a fixture similar to that of Ohm '377 with a non-translucent wall, the fixture efficiency would be greatly diminished. In addition, the lack of a photometrically designed reflector would diminish the obtainable efficiency of the fixture.

U.S. Pat. No. 2,534,182 of Schwartz has different angles for reflectors 31, 32, 33 that don't control uplighting. Their rounded lenses are not as efficient as using a flat lens.

In U.S. Pat. No. 2,548,500 of Sachs, the position of the reflector 15 beneath the fluorescent lamp tubes causes 50% of light up and 50% down, not a preferable controlled 5 19% as uptight. Also, if one removes the item 15 of Sachs, one accumulates dirt within the fixture.

U.S. Pat. No. 6,428,183B1 of McAlpin gets 100 percent of light up with visual waste and needs extra upper lamps 32,33 with separate mounts. These upper lamps are exposed and subject to dirt accumulation.

U.S. Pat. No. 5,806,967 of Soorus is mainly a V-shaped uptight fixture open at top, so dirt will invariably accumulate therein.

U.S. Pat. No. 2,545,058 of Walsh has an open top with susceptibility to dirt accumulation. Walsh is mainly uptight only as in FIG. 10 therein.

U.S. Pat. No. 2,474,341 of Wince doesn't have a reflector.

U.S. Pat. No. 2,348,930 of Shepmoes has a V-shape end view configuration of lamp fixtures. Downward light is less than 70%.

U.S. Pat. No. 2,327,230 of Weber is only concerned with access removal of the lens portion 27. Lighting inefficiency is similar to Shepnoes.

U.S. Pat. No. 2,320,829 of Naysmith and U.S. Pat. No. 2,323,002 of Baker both describe V-shaped arrangement of lamps, which does not control uplight.

Therefore, there is a need to provide a fluorescent lamp fixture which controls uplight to a desirable level, without wasting excess light, while significantly reducing an undesirable cave effect and without the tendency to accumulate dirt within the fixture.

SUMMARY OF THE INVENTION

It is therefore an object of the present invention to provide a fluorescent lamp fixture which controls uptight to a desirable level, without wasting excess light, while significantly reducing an undesirable cave effect and without the tendency to accumulate dirt within the fixture.

In keeping with these objects and others, which may become apparent, the fixtures of this invention accommodate straight fluorescent tube lamps of a variety of lengths and electrical design, for example popular four foot sizes. These fixtures have a full upper housing protecting all lamps from the accumulation of dust and debris while providing a controlled amount (5 to 19%) of total light output to uplighting, thereby lighting ceiling and wall areas above the fixture, to negate the so-called "cave effect". The percentage range of 5 to 19 percent of total uplighting is controlled relative to the quantity of lamps utilized, the angle of the reflector, the height of the outside section of the fixture and the dimensions and orientation of light transmissive windows, which also impact the angle of the outboard reflector.

The fixtures of this invention have a central section (from an end view) aimed directly below the fixture with lamp or lamps within a concave reflector or reflectors. Wing sections at an oblique angle extend sideways from the central section, carrying their own lamps and reflectors with totally or largely open distal ends, thereby accommodating uplighting in a controlled fashion. The uplighting provided is at an oblique angle from the fixture, as contrasted from prior-art fixtures with dedicated uptight lamps, or direct vertical upward lenses or windows, which would reflect uptight directly down from the ceiling surface.

These lighting fixtures preferably incorporate a trapezoidal pendant bracket, which accurately positions the fixture with respect to the pendant pipe and prevents any tendency of the fixture from deviating from orthogonal orientation with respect to the ceiling. However, the pendant bracket of the present invention is usable on any type of suspended light fixture, to stabilize the fixture in place.

In one embodiment the fixture has no lens and the oblique housing sides have light transmissive openings sized to transmit a selected portion of light to accommodate uplighting. In a second embodiment, a high efficiency lens is used for downlighting and the oblique housing sidewalls are fitted with light transmissive or transparent windows which are preferably glazed with flat high efficiency lens panels to accommodate uplighting. Each of these embodiments can accommodate a variety of lamp configurations ranging from three to eight fluorescent lamps per fixture.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 6 is an End view of a 3-lamp configuration of a fluorescent lamp fixture of this invention;

FIG. 7 is an End view of a 4-lamp configuration of a fluorescent lamp fixture of this invention;

FIG. 8 is an End view of a 5-lamp configuration of a fluorescent lamp fixture of this invention, also indicating geometric features permitting a controlled amount of uplighting;

FIG. 9 is an End view of a 6-lamp configuration of a fluorescent lamp fixture of this invention; and, FIG. 10 is an End view of an 8-lamp configuration of a fluorescent lamp fixture, in accordance with the present invention.

DESCRIPTION OF THE PREFERRED EMBODIMENT

Figure 1:
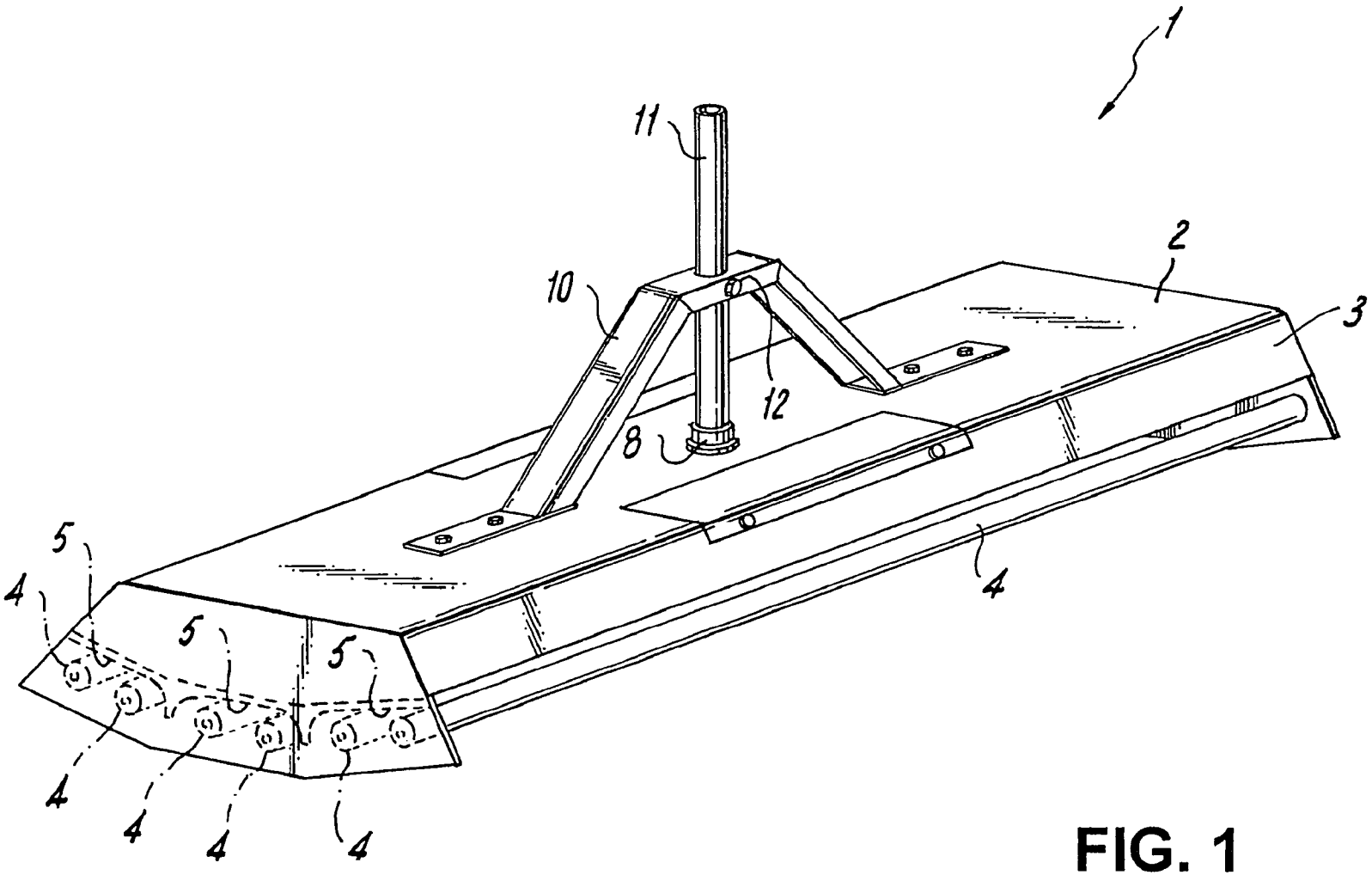
FIG. 1 is a Perspective view illustrating a fluorescent lamp fixture with no lens, in accordance with the present invention.

FIG. 1 shows the first embodiment of this invention, wherein fixture 1 uses no lenses. Fixture 1 has six straight fluorescent tubes 4 within housing 2 with shortened oblique walls 3. Central concave reflector 6 is aimed straight down while side reflectors 5 are angled obliquely and have no curved section (or a very truncated one) at their distal ends. Reflector surface finish can vary, however a white finish, a specular reflector, or an enhanced specular reflector surface with 95% reflectivity are currently offered.

Pendant pipe 11 is used to attach fixture 1 to a ceiling structure; it also carries wiring within. It is mounted in hub 8 and is located accurately by trapezoidal pendant bracket 10 and secured by pendant screw 12. However, pendant bracket 10 is usable on any type of suspended light fixture, to stabilize the fixture in place.

Figure 2:
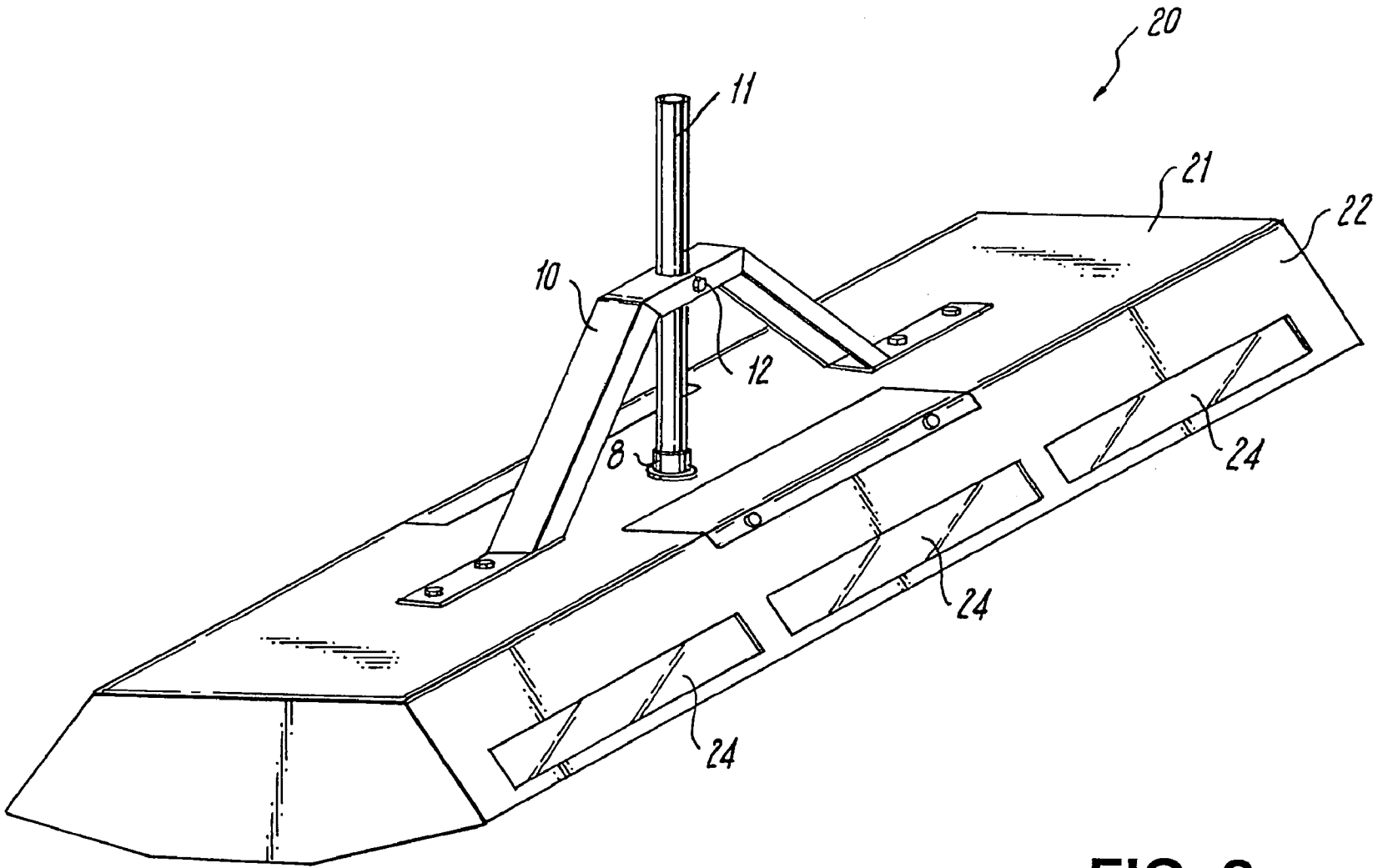
FIG. 2 is a Perspective view of a fluorescent lamp fixture of a second embodiment of this invention incorporating lenses.

In a second embodiment, fixture 20 of FIG. 2 has housing 21 with full oblique walls 22. Walls 22 have three rectangular windows 24 with flat high efficiency lenses to permit a controlled amount of uplighting.

Fixture 20, as shown in FIG. 2, includes housing 21 which has an elongated horizontal top surface with side edges along an elongated length of the top surface and edges at opposing ends of the top surface. Opposing oblique side walls 22 have flat surfaces extending from the side edges of the top surface and the opposing oblique side walls are shown to flare at an angle downwardly and outwardly from the side edges of the top surface. Opposing end walls extend downwardly from the edges at the opposing ends of the top surface and the oblique side walls and end walls join to form a downwardly facing opening in housing 21. Referring to FIGS. 2-5, a plurality of generally downwardly facing reflectors within housing 21 extending the length of the housing, and a plurality of elongate fluorescent light bulbs 4 are mounted parallel to each other in housing 21 and beneath the reflectors so that light from the light bulbs reaching the reflectors is reflected generally downwardly. The bulb mounting arrangement includes at least one central light bulb and at least first and second (or left and right) side light bulbs adjacent the opposing oblique side walls 22. In the exemplary embodiment of FIGS. 2 and 3, the oblique walls 22 each include a light transmissive area configured to allow a portion of light from a light bulb 4 to be directed in a generally upward direction to provide indirect lighting. The fluorescent light fixture 20 shown in FIGS. 2-5 has windows 24 which together define light transmissive area in each of the oblique side walls 22. Windows 24 define a plurality of spaced elongate openings aligned along a line that is substantially parallel to the adjacent side light bulbs, and wherein the window openings are sized to allow a controlled amount of light from an adjacent side light bulb to be directed upwardly. In the exemplary embodiment of FIGS. 2-4 there are three aligned window openings, and each elongated opening is separated from the next by solid, opaque supporting sidewall material adapted to support lens covers or the like. In a preferred embodiment, the fluorescent light fixture has a transparent lens covers over one or more of the elongate window openings 24. Optionally, semitranslucent lens covers are configured over one or more of the elongate openings. The fluorescent light fixture 20 optionally has two or more light bulbs located under at least some of the reflectors. Fluorescent light fixture 20 thereby directs a portion of the total light generated within the fixture such that a controlled portion of that light is directed upwardly; the controlled portion of light directed upwardly is in the range of about 5 to 19 percent.

Figure 4:
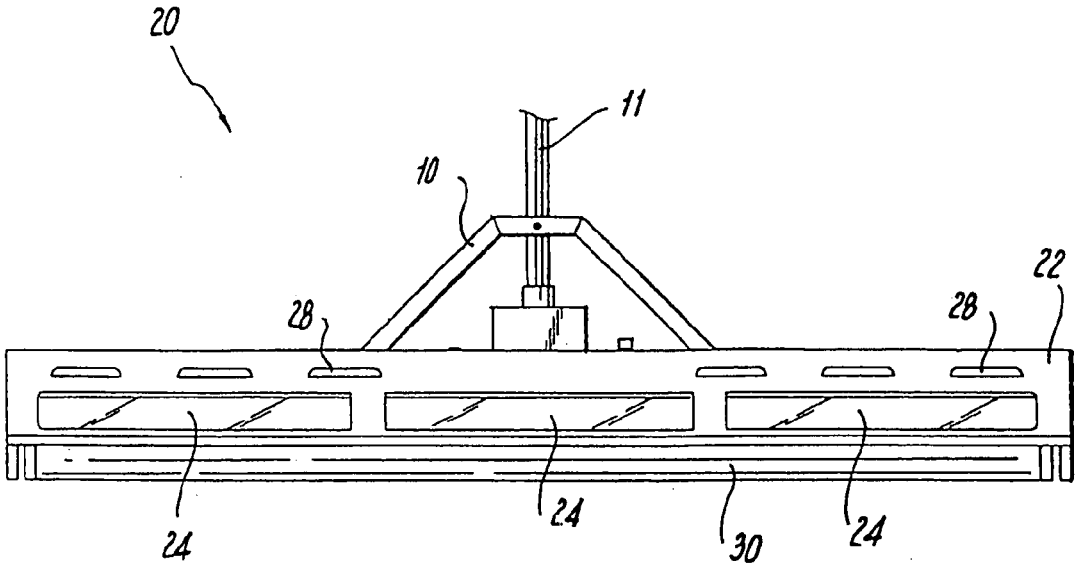
FIG. 4 is a Side elevational view of the fluorescent lamp fixture of FIG. 3.
Figure 5:
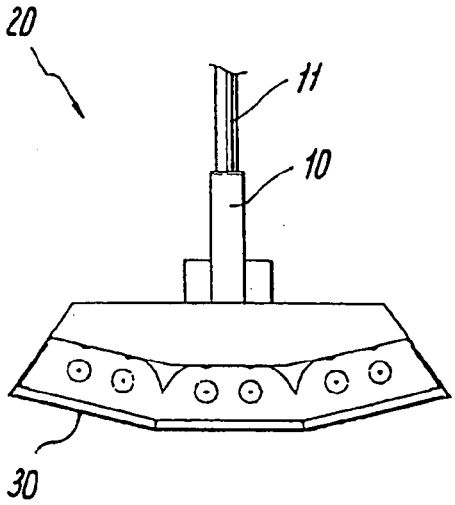
FIG. 5 is an End view of the fluorescent lamp fixture of FIG. 3.

As best seen in FIGS. 4 and 5, fluorescent light fixture 20 is suspended spaced from a ceiling by a pendant bracket 10, and the pendant bracket's vertical support pipe 11 has a length chosen to suspend housing 21 at a distance from the ceiling selected to enhance the effect of said upwardly directed light's indirect lighting. The fluorescent light fixture 20 preferably includes pendant bracket 10 and vertically extending support 11 intersected by a longitudinally extending trapezoidal bracket extending longitudinally along a top surface of fluorescent lamp fixture 20.

Figure 3:
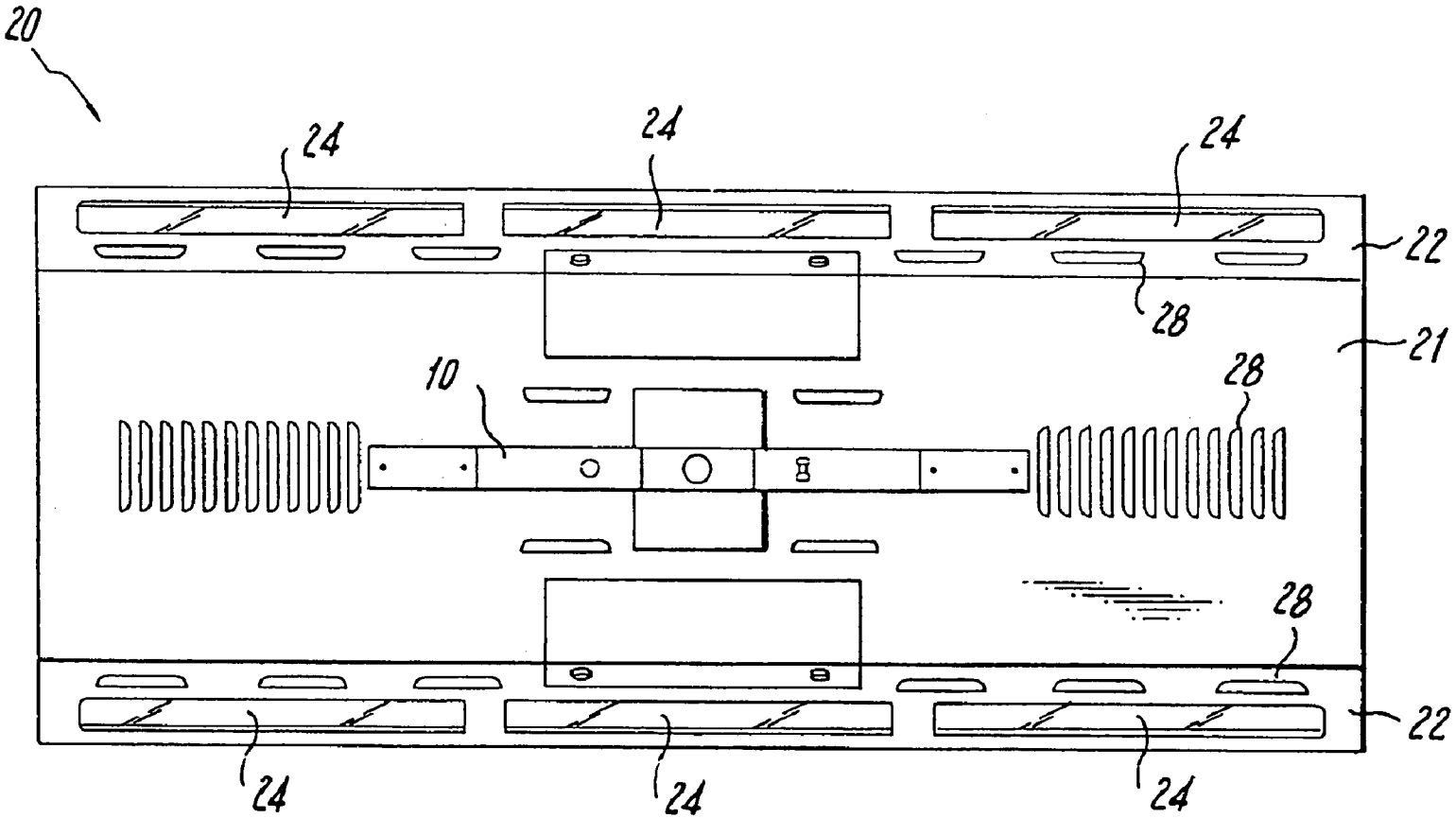
FIG. 3 is a Top plan view of a fluorescent lamp fixture of this invention (shown with lenses)

FIGS. 3, 4, and 5 present top, side and end views of fixture 20 respectively. Vent louvers 28 are used to permit air circulation for cooling of ballasts and lamps while excluding dust contamination. High efficiency downlight lens 30 covers the fluorescent tubes.

A variety of lamp configurations for the fixtures of this invention are shown in the end views of FIGS. 6 and 10.

For example, FIG. 6 shows a 3-lamp fixture 40 with a single lamp 4 in central reflector 41 and a single lamp in each side reflector 42.

FIG. 7 shows a 4-lamp fixture 50 with two lamps within central reflector 51 and single lamps within side reflectors 52.

FIG. 8 shows a 5-lamp configuration 60 with a single lamp in central reflector 61 and two lamps in each side reflector 62. Uplighting rays 64 are shown emanating from right side to illustrate the geometric relationships between the lamp 4 location with respect to reflector 62, truncated end curve 63 and tube 4 surface. Reflector end 63 provides the uptight cut-off and the structural configuration of the reflectors, lamp location, oblique angle, and lamp fixture population permits design of fixtures with uptight percentage fixed as desired, preferably between 5 19% of total.

Figure 5A:
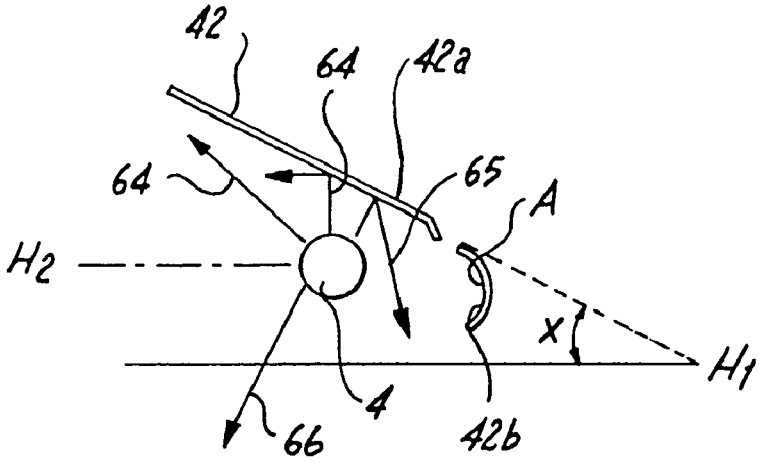
FIG. 5A is a close-up detail side view showing the reflectance of the light rays of fluorescent lamps of the fluorescent lamp fixture of this invention, due to the angle and arc of the reflector having an oblique portion and an arcuate portion.

For example, FIG. 5A shows the reflectance of the light rays 64, 65 and 66 of fluorescent lamps 4 due to the angle X and arc A of the reflector 42. Reflector 42 has a straight oblique portion 42*a* and an arcuate portion 42*b*. A certain portion of rays, emitted from lamp 4 designated as rays 64, are either emitted upward or are reflected off of portions of reflector 42 in an upward direction. Another portion of rays designated as rays 65 are emitted and directed up, but reflected down by either the straight oblique portion 42*a* or the arcuate portion 42*b* of reflector 42. A third portion of rays designated as rays 66 are emitted and directed down. Therefore rays 64 are the only light rays which constitute any uplighting of light from fixture 42. The amount of uplighting is controlled by controlling the angle X of straight oblique portion 42*a* off of imaginary horizontal line H1 and the arc A off arcuate portion 42*b*, off of imaginary horizontal line H1. As a result, a certain percentage of light, such as, for example, 5 to 19 percent, constitutes uplight directed above imaginary horizontal line H2 through the middle of lamp 4, either directly upward from lamp 4 or indirectly upward from lamp 4 via reflector portions 42*a* or 42*b*. The remaining portion of emitted rays are either emitted indirectly downward from lamp 4 below imaginary horizontal line H2 off of the center of lamp 4, via reflector portions 42*a* and/or 42*b*, or directly downward in the form of rays 66 from lamp 4.

Figure 5B:
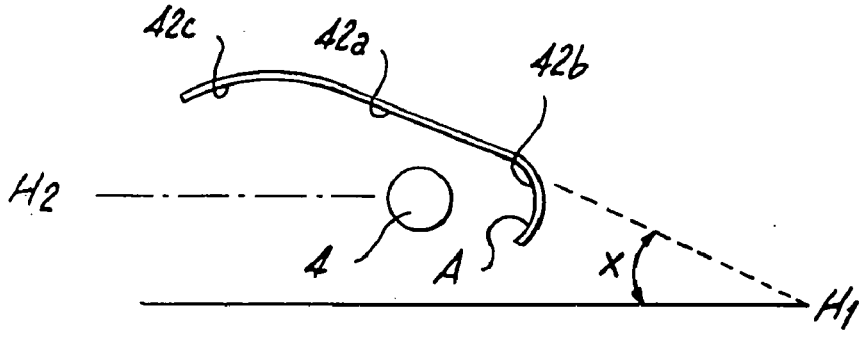
FIG. 5B is a close-up detail side view showing the reflectance of the light rays of fluorescent lamps due to the angle and arc of another embodiment for the reflector having small arcuate concave portion, an oblique portion and an inner arcuate concave portion.

FIG. 5B shows another embodiment of the reflectance of the light rays 64, 65 and 66 of fluorescent lamps 4 due to the angle and arc of the reflector having a first arcuate concave outer portion 42*c*, a second straight oblique portion 42*a* and a third inner arcuate concave portion 42*b*. While the preferable percentage of uplighting is 5 to 19 percent of emitted light reflected above imaginary line H2, that percentage of uplighting can be varied by adjusting the angle of oblique reflector portion 42*a*, inner arcuate concave portion 42*b* and/or outer arcuate concave portion 42*c* of reflector 42.

Besides the differences in the configuration of reflector 42 and in the variations in angle X shown in FIGS. 5A and 5B, the actual size of reflector 42 and its location (i.e. distance from) relative to lamp 4 also have a bearing on the percentage of uplighting.

FIG. 9 shows a 6-lamp design 70 with two lamps in central reflector 71 as well as in each of two side reflectors 72. FIG. 10 shows an 8-lamp fixture 80 with two down reflectors 81 in the central section with two lamps each. Oblique side reflectors 82 also have two lamps each.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

Having described preferred embodiments of a new and improved illumination apparatus and method, it is believed that other modifications, variations and changes will be suggested to those skilled in the art in view of the teachings set forth herein. It is therefore to be understood that all such variations, modifications and changes are believed to fall within the scope of the present invention as set forth in the following claims.

What is claimed is:

1. A fluorescent light fixture, comprising:

a housing having an elongated horizontal top surface with side edges along an elongated length of said top surface and edges at opposing ends of said top surface;

oblique side walls having flat surfaces extending from the side edges of said top surface, said oblique side walls flaring downwardly and outwardly from said side edges;

end walls extending downwardly from the edges at the opposing ends of said top surface, said oblique side walls and end walls joining to form a downwardly facing opening in said housing;

a plurality of generally downwardly facing reflectors within said housing extending the length of said housing;

a plurality of elongate fluorescent light bulbs mounted parallel to each other in said housing beneath said reflectors so that light from said light bulbs reaching said reflectors is reflected generally downwardly including at least one central light bulb and side light bulbs adjacent said oblique side walls;

said oblique walls each including a light transmissive area configured to allow a portion of light from a light bulb to be directed in a generally upward direction to provide indirect lighting;

wherein the light transmissive area in each of said oblique side walls comprises a plurality of spaced, elongate openings aligned along a line that is substantially parallel to said side light bulbs;

wherein said openings are sized to allow a controlled amount of light from an adjacent side light bulb to be directed upwardly.

2. The fluorescent light fixture of claim 1 in which a transparent lens covers at least one of said elongate openings.

3. The fluorescent light fixture of claim 1 in which a semi-translucent lens covers at least one of said elongate openings.

4. The fluorescent light fixture of claim 1 in which multiple light bulbs are located under at least some of said reflectors.

5. The fluorescent light fixture of claim 1 in which said housing is suspended from a ceiling.

6. The fluorescent light fixture of claim 5 in which a pendant bracket is employed to suspend said housing at a distance from the ceiling selected to enhance the effect of said upwardly directed light's indirect lighting.

7. The fluorescent light fixture of claim 6 wherein said pendant bracket comprises a vertically extending support intersected by a longitudinally extending trapezoidal bracket extending longitudinally along a top surface of a fluorescent lamp fixture.

8. The fluorescent light fixture of claim 1 in which the portion of total light directed upwardly is in the range of about 5 to percent.

* * * * *

UNITED STATES PATENT AND TRADEMARK OFFICE

CERTIFICATE OF CORRECTION

PATENT NO. : 7,594,736 B1
APPLICATION NO. : 11/976194
DATED : September 29, 2009
INVENTOR(S) : Charles E. Kassay et al.

It is certified that error appears in the above-identified patent and that said Letters Patent is hereby corrected as shown below:

Claim 8 (beginning at column 6, line 55) should correctly be "8. The fluorescent light fixture of claim 1 in which the portion of total light directed upwardly is in the range of about 5 to 19 percent."

Signed and Sealed this

Twenty-fourth Day of November, 2009

David J. Kappos

David J. Kappos
*Director of the United States Patent and Trademark Office*